United States Patent [19]

Baggey

[11] 4,207,631

[45] Jun. 17, 1980

[54] DRAIN STRAINER

[76] Inventor: Gary Baggey, R.R. #4, Bright, Ontario, Canada

[21] Appl. No.: 928,165

[22] Filed: Jul. 26, 1978

Related U.S. Application Data

[63] Continuation-in-part of Ser. No. 831,782, Sep. 9, 1977, abandoned, which is a continuation of Ser. No. 676,742, Apr. 14, 1976, abandoned.

[51] Int. Cl.[2] ..... E03C 1/26

[52] U.S. Cl. ..... 4/286; 4/291; 4/DIG. 14; 210/238

[58] Field of Search ..... 4/190, 189, 286, 288, 4/290–292, 287, 1, 289, 295, DIG. 14, 255–257; 210/238, 470, 471; 220/94 R; 206/163, 164; 137/549

[56] References Cited

U.S. PATENT DOCUMENTS

| | | | |
|---|---|---|---|
| 674,294 | 5/1901 | Cox | 4/291 X |
| 814,481 | 3/1906 | Savard | 4/190 |
| 1,574,336 | 2/1926 | Blydenburgh | 210/238 X |
| 1,589,544 | 6/1926 | Natow et al. | 4/189 |
| 1,688,429 | 10/1928 | Murden | 210/470 X |
| 1,751,877 | 3/1930 | Nance | 4/190 |
| 2,279,683 | 4/1942 | Judell et al. | 4/288 |
| 4,045,351 | 8/1977 | Peterson | 4/190 X |

*Primary Examiner*—Stuart S. Levy
*Attorney, Agent, or Firm*—Robert D. Farkas

[57] ABSTRACT

This disclosure pertains to strainers adapted to be inserted within drain openings, located in floors, sinks, and tubs, having a handle attachment fitted to a reticulated or foraminated cup-like strainer. The handle may either rotate or retract or both so as to become substantially flush with the surface containing the drain opening. The strainer has a supporting mechanism for resting on the floor or on a recess adjacent the drain opening in the floor.

7 Claims, 9 Drawing Figures

DRAIN STRAINER

This application is a continuation in part of prior U.S. application Ser. No. 831,782 filed Sept. 9, 1977, now abandoned, which is a continuation of U.S. application Ser. No. 676,742 filed Apr. 14, 1976, now abandoned.

BACKGROUND OF THE INVENTION

.1 The Field of the Invention

This invention relates to drain strainers and more particularly to that class having strainer supporting means and including a rotatable or retractable handle affixed thereto.

2. Description of the Prior Art

The prior art abounds with strainers utilized to protect drains and traps therebelow from being clogged with debris entering the drain opening. U.S. Pat. No. 1,751,877 issued Mar. 25, 1930 to W. B. Nance teaches a drain trap secured with a bolt within a drain opening such that the uppermost surface of the trap lies substantially in the plane of the floor of the sink. U.S. Pat. No. 1,589,544 issued June 22, 1926 to S. Natow et al discloses a cylindrical strainer supported by an annular flange that protrudes over the surface of the floor of the sink, having four cavities within the strainer, substantially permitting the strainer to surround and pass through openings created by the conventional cross bar internal drain support members commonly found in most sink installations. U.S. Pat. No. 814,481 issued Mar. 6, 1906 to A. Savard shows a foraminated cup-like member having a flange extending radially outwardly from the free edges thereof. The flange is used to sit within a recess located adjacent the opening of the drain. All of the aforementioned Patents suffer the common deficiency of either not providing any drain strainer handle at all, or if such a handle is available, it protrudes above the surface of the floor surrounding the drain opening. In all cases, prior apparatus, utilizing handles, have the handle fixedly secured within the strainer, obstructing thereby, the retention capabilities of large sized debris, such as encountered in slaughter houses and the like.

SUMMARY OF THE INVENTION

A primary object of the present invention is to provide a strainer apparatus having a conveniently located flush type handle affixed thereto.

Another object is to provide a strainer with a handle that may retract from below its uppermost extended position to a withdrawn inwardly stored position.

Still another object is to provide a strainer having a handle which can rotate to a storage position adjacent the side walls of the strainer.

Yet another object is to provide a reticulated strainer of inexpensive construction suitable for use in large drain openings.

A further object is to provide strainers whose shapes accommodate rectangular or circular openings and which are adapted with rotatable and retractable handles.

Another object is to provide a handle which may pivot away from the opening in the strainer facilitating the convenient emptying thereof of debris or waste material accumulated therein.

A still further object is to provide a strainer whose bottom may be opened selectively so as to facilitate the draining of large particles of waste after the drain has been cleared of small waste particles under hydraulic pressure.

Slop drains, commonly found in meat packing houses, large restaurants, and other industrial installations, are often required to be cleaned due to their clogging because of the quantity and size of the waste materials handled thereby. There is a need to equip such drains with wide mesh reticulated strainers and substantially lie flush with the floor in which the drain opening is located. Because of the volume of debris handled by the drain, such strainers are required to be frequently moved and emptied without utilizing special tools therefor.

The instant invention discloses a variety of shaped reticulated strainers adapted to be inserted into the drain opening and supported by the drain bearing floor. A handle is pivotably secured to the walls of the strainer so that, in one mode, the handle utilized for removal of the strainer may be rotated to a preferred storage position adjacent the side walls of the strainer, leaving the strainer opening unobstructed. The handle may also be permitted to be pivotably secured to the strainer walls and, through the use of slots, be permitted to retract downwardly towards the lowermost point of the strainer. Such handles may be secured to the inside or outside surfaces of the strainer utilizing rivets therefor.

The handle, whilst residing below the uppermost marginal edges of the strainer, is disposed below any point on the floor accommodating the strainer. The handle may then be pulled upwardly so as to be accessible above the surface of the floor. In this elevated position, the non-rotatable version of the handle may be rotated and is coupled to a floor portion of the strainer so as to cause such floor portion to be rotated as well. When the floor portion is uncoupled from the walls of the strainer, it may be pulled upwardly with the accumulated debris thereon so as to elevate such debris above the surface of the floor, effectively cleaning out the strainer from large accumulated particles of debris.

These objects, as well as other objects of the present invention, will become more readily apparent after reading the following description of the accompanying drawings.

DESCRIPTION OF THE PREFERRED EMBODIMENT

Figure 1:
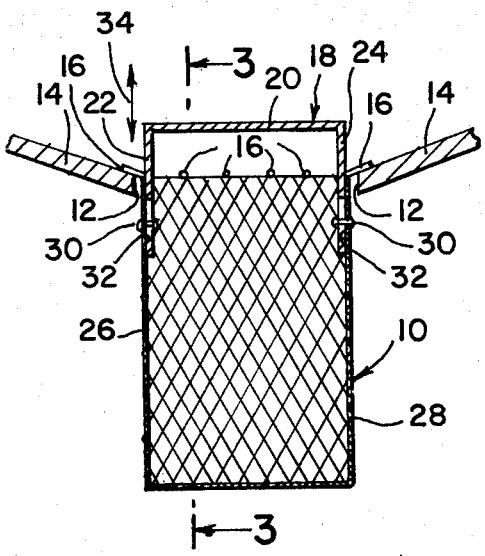
FIG. 1 is a side elevation cross-sectional view of a rectangular strainer installed within a drain opening located in a floor tapering downwardly towards the drain opening.

The structure and method of fabrication of the present invention is applicable to a strainer fabricated from a mesh-like material such as stainless steel. The strainer is permitted to have any desirable waste retaining shape such as a rectangular, circular, or conical shape, and is provided with a mounting device used to support the strainer within the drain opening. Such a mounting device includes outwardly extending fingers affixed to the strainer in the area of the open edges thereof. The fingers engage the floor surrounding the drain opening or a recess in the floor adjacent the drain opening. An inverted U-shaped handle is affixed to the side walls of the strainer utilizing rivets therefor passing through slots in the two side arms of the U-shaped handle. The handle may be extended upwardly and downwardly along the length of the slots formed therein and may rotate or pivot about the rivets so that the handle may store in a plane parallel to the floor if desired. The handle may be secured to the innermost or outermost surfaces of the strainer and may have a pair of outwardly extending wings affixed at the intersection of the ends of the hand grasping portion and the side arms bearing the slots. The wings may be utilized, if provided, to support the strainer therebelow by resting on the surface of the floor surrounding the drain or if provided, on a strainer which utilizes protrusions to the strainer for supporting purposes, to add supporting strength to the hand grasping portion of the handle, resisting downward forces which, when applied to the handle, tends to deform the strainer out of its desired shape.

Disposing the uppermost part of the handle above the level of the floor, causes such handle to represent a hazard to personnel traversing the floor and tends to expose such handle to accidentally applied forces, resulting in damage or breakage thereof. Another embodiment of the present invention utilizes a handle secured to the base regions of the strainer, such that the uppermost end of the handle is disposed residing below the uppermost surface of the strainer when the handle is not being utilized. Grasping the wings of the handle, loosely positioned in a horizontal plane, and applying an upward force thereto, permits the handle to be relocated above the surface of the floor. In this position, the handle may be conveniently employed to remove the strainer from the drain opening carrying the strainer.

Conventional strainers accumulate small waste particles as well as large waste particles. The largest of the waste particles can never pass through the openings in the strainer container. Some of the smaller waste particles accumulate within the strainer even though they are capable of passing therethrough. Applying a substantial hydraulic force, usually by way of a stream of water under pressure, to a strainer having large and small waste particles therein, results in the large waste particles interferring with the effective cleaning of the strainer walls by a water stream directed on the interior surfaces thereof. Removal of the large particles, whilst maintaining the strainer in the drain hole, facilitates utilizing water or other devices to clean the strainer, permitting the water to enter into the drain opening directly. This eliminates handling of a dirty strainer, transporting same to an area to be cleaned whereby such cleaning area must have independent drainage facilities. The present invention utilizes a bottom portion of the strainer, threadingly engaged to the remaining portions of the strainer, and carrying the handle slidably affixed to an opening. The handle in the raised or lowered position may be utilized to release the base portion of the strainer, by rotating both at the same time, causing the base of the strainer to be pulled upwardly through the interior of the strainer, taking along with it the supported large waste particles. The base of the strainer is then maintained opened during the cleaning operation whilst the strainer is retained in the drain hole. Means are provided whereby the handle assembly is keyed to the lower portions of the strainer, in anti-turn fashion, and prevented from falling in unlimited fashion down to the base regions of the strainer.

Now referring to the Figures, and more particularly to the embodiment illustrated in FIG. 1 showing a rectangularly shaped strainer 10 installed within an opening 12 in floor 14. Fingers 16 extend outwardly from the rim of the uppermost major opening of the strainer 10 and support the strainer on floor 14. Handle 18 has a hand grasping portion 20 and side arms 22 and 24. The side arms are pivotably secured on the inside surfaces of walls 26 and 28 of strainer 10 utilizing rivets 30 therefor. The rivets engage slots 32 located in side arms 22 and 24. Thus, handle 18 may move in the direction of arrows 34 and concurrently may pivot about rivets 30 so as to store within strainer 10 as desired.

Figure 2:
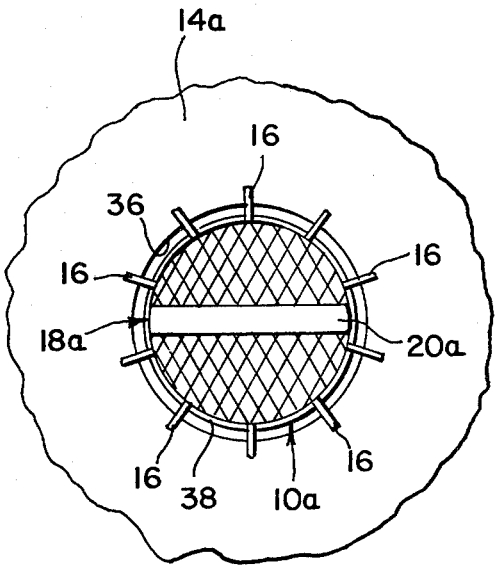
FIG. 2 is a plan view of a circular strainer and a portion of the surrounding level floor.

FIG. 2 illustrates the uppermost lateral surface of a portion of a flat floor **14*a* containing a circular drain opening 36 therein. Fingers 16 support circular strainer 10*a* within opening 26. Handle 18*a* is provided with a hand grasping portion 20*a* and is secured to the outermost surfaces 38 of strainer 10*a* utilizing the handle mounting means shown in FIG. 1, including rivets 30, slots 32, and side arms 22 and 24 therefor. Handle 18*a* may be pulled outwardly from floor 14*a* to remove strainer 10*a* from opening 36 or, alternatively, handle 18*a* may be pulled outwardly and rotated so as to rest on floor 14*a***, if so desired.

Figure 3:
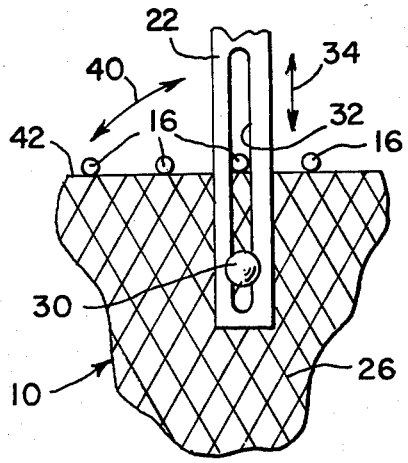
FIG. 3 is a partial side elevation view taken along line 3—3 viewed in the direction of arrows 3—3 of FIG. 1 showing a portion of a handle and a portion of a strainer.

FIG. 3 illustrates a portion of strainer 10 to which is secured rivet 30. Side arm 22 has slot 32 located therein, through which rivet 30 passes. Side arm 22 if free to be moved in the directions of arrows 34 and to be rotated in the directions of arrows 40, utilizing rivet 30 as a pivot point for side arm 22. Surface 26 is of reticulated design and has supporting fingers 16 extending outwardly from edge 42.

Figure 4:
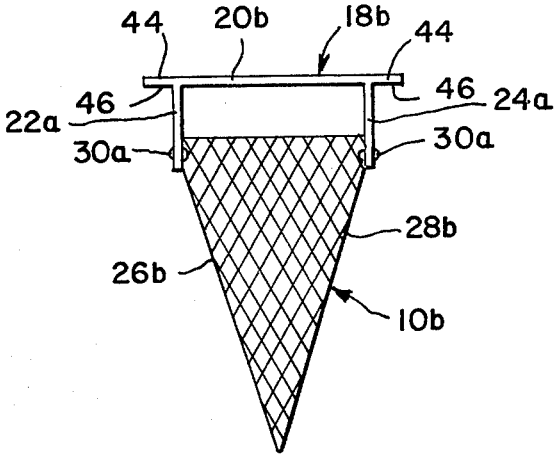
FIG. 4 is a side elevation view of a cone shaped strainer and a handle extending therefrom having supporting wings.

FIG. 4 illustrates a cone-shaped strainer **10*b* to which is affixed handle 18*b*. Hand grasping portion 20*b* is secured to strainer 10*b* at surfaces 26*b* and 28*b* utilizing rivets 30*a* therefor. Wings 44 are co-extensive with hand grasping portion 20*b*. The undermost surfaces 46 of wings 44 may, if desired, be utilized to support strainer 10*b* within an opening in a floor, not shown. In such a case, rivets 30*a* could be engaged within holes in side arms 22*a* and 24*a*. Alternatively, side arms 22*a* and 24*a* may be adpated with slots 32, and strainer 10*b* may be provided with outwardly extending fingers 16, as shown in FIG. 1, and utilized to support the strainer 10*b* within an opening 12 in the floor 14. In such an event, lowermost surfaces 46 of wings 44 rest upon the floor surrounding the opening in which the strainer 10*b* is located and provide additional support for the hand grasping portion 20*b*, which is free to rotate and retract utilizing slot 32** therefor.

The handle 18b may be adapted to the rectangular shaped strainer 10 shown in FIGS. 1 and 3, or to the circular shaped strainer 10a shown in FIG. 2.

Strainer 10b may be employed with handle 18b or, alternatively, with handle 18 as shown in FIG. 1. Strainer 10a, shown in FIG. 2, may employ handle 18b, as shown in FIG. 4. Strainer 10, as shown in FIG. 1, may, if desired, employ handle 18b as shown in FIG. 4. In the event that handle 18b is employed with strainer 10a, as shown in FIG. 2, or strainer 10, as shown in FIG. 1, surfaces 46 may engage the floor portion surrounding the opening in which the strainer is located. However, handle 18b cannot be folded inwardly into the opening of the strainer due to the outwardly projecting wings 44 thereof. As in the case of strainer 10b, shown in FIG. 4, fingers 16 shown in FIGS. 1, 2, and 3 may be deleted when utilizing surfaces 46 to support the strainer 10 or 10a, shown in FIGS. 1 and 2, respectively.

Figure 5:
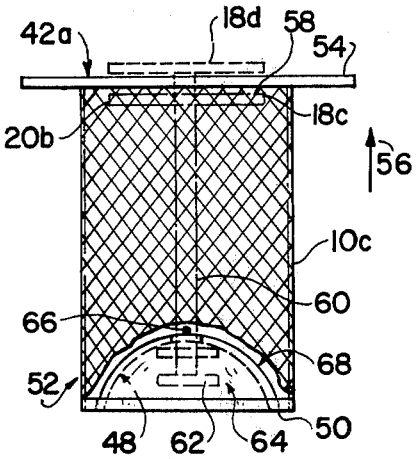
FIG. 5 is a side elevation view of another embodiment of the present invention.

FIG. 5 illustrates handle 20b shown disposed within strainer 10c. Base portion 48 is threadingly engaged at region 50 to side wall portion 52. Handle portion 18c is shown disposed below uppermost marginal edges 42a, adjacent to annular washerlike ring 54. Washer 54 secured to strainer 10c is used to provide vertical support for the strainer in a drain hole, similar to the drain hole opening 36, shown in FIG. 2. Dotted lines 18d simulate the position of handle 18c when such handle is disposed upwardly in the direction of arrow 56, by an applied force applied to wing portions 58 of handle 18c. Shaft portion 60 of handle 18c is disposed within strainer 10c having portion 62 thereof located within cavity 64 in base portion 48. Pin 66 is shown residing on uppermost lateral surface 68 of base portion 48, preventing handle 20b from further downward displacement.

Figure 6:
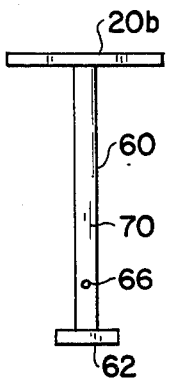
FIG. 6 is a side elevation view of the handle portion shown in FIG. 5.

FIG. 6 shows handle 20b having the wide lateral surface 70 of handle portion 60 carrying pin 66.

Figure 7:
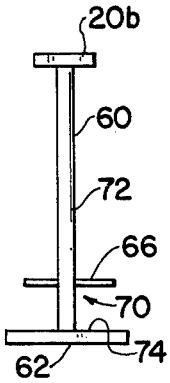
FIG. 7 is another side elevation view of the apparatus of FIG. 6.

FIG. 7 illustrates the narrow surface 72 of handle portion 60 having pin 66 extending outwardly from wide surfaces 70. Portion 62 is shown having end 74 exposed to view.

Figure 8:
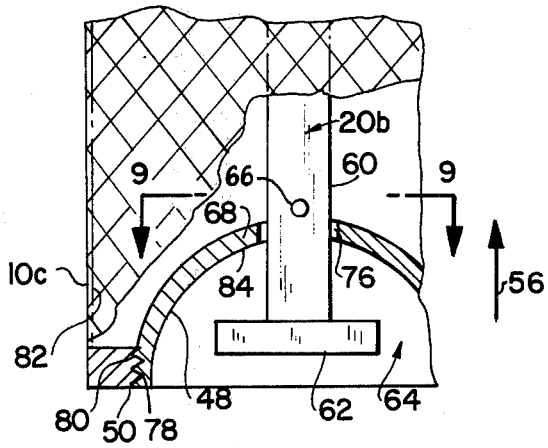
FIG. 8 is an enlarged side elevation view of the apparatus shown in FIG. 5.

FIG. 8 illustrates portion 60 of handle 20b extending through opening 76 in base portion 48. Threads 78 are shown disposed on the exterior surfaces, circular in shape, of base portion 48. Threads 80 threadingly engage threads 78 and are disposed inwardly of internal surfaces 82 of strainer 10c. Releasably securing means are provided by which threads 78 and threads 80 may be engaged or disengaged from one another by the manual rotation of portion 60. When such threads are disengaged from one another, base portion 48 may reside within strainer 10c and may be carried on portion 62. Thus, base portion 48 may be moved upwardly, in the direction of arrow 56, when threads 78 and 80 are disengaged from one another and when portion 62 of handle 20b is disposed upwardly, in the direction of arrow 56, so as to have portion 62 of the handle engage and carry thereon the innermost lowermost surface 84 of portion 48. Other locking means, different in construction from threads 78 and 80 may be employed such as cammed surfaces engaging cam receiving grooves or the like.

Figure 9:
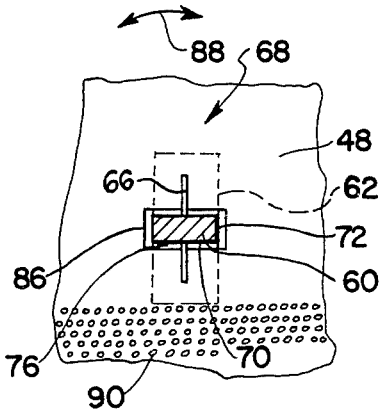
FIG. 9 is a plan view taken along lines 9—9 viewed in the direction of arrow 9—9, of the apparatus shown in FIG. 8.

FIG. 9 illustrates uppermost surfaces 68 of base portion 48 having rectangular opening 76 therein. Portion 60 of handle 20b, shown in FIG. 5, is shown passing therethrough. Side 70 of portion 60 is shown being wider than side 86 of opening 76. Thus, when portion 60 is rotated in the direction of arrows 88, base portion 48 rotates therewith. At all times, opening 76 is sized so as to permit portion 60 to easily slide therethrough. Surface 68 may be provided with openings 90 if desired. Such openings facilitate base portion 48 acting as a strainer as well.

It should be noted that base portion 48 having circular marginal edges, is permitted to ride upwardly in strainer 10c in the opening therewithin. Base portion 48 may be fitted to strainer 10b, shown in FIG. 4, wherein such strainer is disposed having a truncated conical exterior surface. It should also be noted that cavity 64, shown in FIGS. 5 and 8, is defined by lowermost surface 84, shown in FIG. 8, of base portion 48, wherein lowermost surface 84 is an inverted cupshaped surface. If desired, base portion 48 may be flat and disc shape as well.

One of the advantages is a strainer apparatus having a conveniently located flush type handle affixed thereto.

Another advantage is a strainer with a handle that may retract from below its uppermost extended position to a withdrawn inwardly stored position.

Still another advantage is a strainer having a handle which can rotate to a storage position adjacent the side walls of the strainer.

Yet another advantage is a reticulated strainer of inexpensive construction suitable for use in large drain openings.

A further advantage is strainer shapes which accommodate rectangular or circular drain openings and which are adapted with rotatable and retractable handles.

Another advantage is a handle which may pivot away from the opening in the strainer facilitating the convenient emptying thereof of debris or waste material accumulated therein.

A still further advantage is to provide a strainer whose bottom may be opened selectively so as to facilitate the draining of large particles of waste after the drain has been cleared of small waste particles under hydraulic pressure.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosures herein, but only the appending claims.

The embodiment of the invention in which an exclusive privilege or property is claimed are defined as follows:

1. A drain strainer comprising a waste accumulating container, said container having a plurality of holes therethrough, said container having an opening, said opening in said container defining a plane, said opening for the introduction of waste material into said container, supporting means for supporting said container within a drain opening, a handle, said container having a base portion, means to slidably secure said handle to an opening in said base portion, said means to slidably secure including means to limit the upward displacement of said handle from said base portion and means to limit the downward displacement of said handle towards said base portion, means to selectively releasably secure said base portion into and out of the interior of the remaining portions of said container, said handle at the upper end thereof defining a grasping portion extending parallel to the said plane defining said opening in said container, said base portion having an inverted cupshaped surface extending upwardly into said container, said base portion is disposed having circular marginal edges, a plurality of threads being disposed on said marginal edges, said container having a circular opening therein, said circular opening carrying a plurality of female threads, said opening in said base portion defining a width and a size thereof, said handle having at least one lateral surface thereof greater in size than the width of said opening in said base portion whereby rotating said handle causes the rotation of said base portion and the disengagement of said base portion from said remaining portions of said container.

2. The drain strainer as claimed in claim 1 wherein said base portion comprises a plurality of additional openings therein.

3. The drain strainer as claimed in claim 1 wherein said means to limit the upward displacement comprises a bar, said bar fixedly secured to the lower end of said handle and extending transverse thereto, said bar being disposed located below a lower surface of said base portion.

4. The drain strainer as claimed in claim 1 wherein said means to limit the downward displacement comprises a pin, one end of said pin fixedly secured to said handle and extending outwardly therefrom, said pin being disposed located above an upper surface of said base portion.

5. The drain strainer as claimed in claim 1 wherein said supporting means comprises an annular disc extending outwardly from said container and located adjacent said opening in said container.

6. The drain strainer as claimed in claim 1 wherein said container has a cylindrical exterior surface disposed intermediate said opening and said base portion.

7. The drain strainer as claimed in claim 1 wherein said upper end of said handle is disposed within said interior of said container when said means to limit the downward displacement of said handle towards said base portion is employed having a portion of said handle supported by said base portion.

* * * * *